United States Patent [19]

Pierson

[11] Patent Number: 4,843,787

[45] Date of Patent: Jul. 4, 1989

[54] SILL STRUCTURE

[75] Inventor: Roger G. Pierson, Dallas, Tex.

[73] Assignee: Classy Glass, Inc., Lewisville, Tex.

[21] Appl. No.: 122,242

[22] Filed: Nov. 18, 1987

[51] Int. Cl.[4] ..... E06B 1/04

[52] U.S. Cl. ..... 52/204; 52/209; 52/475

[58] Field of Search ..... 52/209, 97, 213, 204, 52/475; 49/505

[56] References Cited

U.S. PATENT DOCUMENTS

| | | | |
|---|---|---|---|
| 2,891,290 | 6/1959 | Hauck . | |
| 3,562,972 | 2/1971 | D'Amato . | |
| 3,638,372 | 2/1972 | Rosenthal . | |
| 4,154,033 | 5/1979 | Krueger . | |
| 4,627,208 | 12/1986 | Esposito . | |
| 4,642,955 | 2/1987 | Webb | 52/204 |
| 4,644,717 | 2/1987 | Biebuyck . | |
| 4,671,027 | 6/1987 | Esposito | 52/105 X |
| 4,715,152 | 12/1987 | Tawikawa | 52/209 |

*Primary Examiner*—Carl D. Friedman
*Attorney, Agent, or Firm*—David H. Judson

[57] ABSTRACT

A sill structure for supporting one or more glass panes of a solarium or the like is described. The sill structure comprises at least first and second elongated bar members each including a bottom wall member having an elongated alignment channel formed therein and opening into the interior of the bar member. The sill structure also includes an elongated flashing member underlying the first and second bar members and movable with respect thereto. The flashing member has an appropriate thickness sized to cooperate with a forward portion of the bottom wall member to enable the first and second bar members to be aligned through the use of an elongated alignment member overlaying the alignment channels thereof. Moreover, each of the bar members includes a suitable support for the glass panes which defines a concealed gutter for improved water drainage. The sill structure also includes appropriate channels and a decorative closure member for supporting light tracks.

9 Claims, 3 Drawing Sheets

SILL STRUCTURE

TECHNICAL FIELD

The present invention relates generally to structural elements for solariums or the like and more particularly to a self-leveling sill with improved drainage capabilities.

BACKGROUND OF THE INVENTION

Structural elements for use in solariums or the like are well known in the prior art. Such elements typically include interconnected horizontal and vertical sill members which support glass panes in a fixed orientation. The sill members also normally include drainage channels which open directly to the exterior thereof for directing water away from the structure. Although structural elements of this type have been widely used, it is often difficult to install such elements in a level fashion with respect to the associated building structure This necessitates manual adjustment to the position of the sill members during installation through the use of shims or the like. Such prior art structural elements also fail to provide adequate water drainage in an efficient yet unobtrusive manner, and these elements do not provide suitable support for decorative lighting.

It would therefore be desirable to provide an improved sill structure for use in a solarium or the like which overcomes these and other problems associated with the prior art.

BRIEF SUMMARY OF THE INVENTION

The present invention describes a novel structural element for a solarium or the like which incorporates self-leveling sill members. Each of the sill members also preferably includes a concealed gutter for unobtrusive water drainage, as well as a plurality of elongated channels for supporting decorative light tracks.

In the preferred embodiment, the sill structure is used to support one or more glass panes of a solarium and comprises at least first and second horizontal elongated bar members. Each of the bar members includes first and second wall members located in substantially parallel aligned relation and each having an outer peripheral surface. Each horizontal bar member also includes a bottom wall member interconnecting the first and second wall members. The bottom wall member has an elongated alignment channel formed therein opening into the interior of the bar member. The sill structure also includes an elongated flashing member underlying the first and second bar members and having a raised edge portion supported for transverse movement in the elongated alignments channels of the first and second bar members for adjusting the position of the elongated flashing member relative to the first and second bar members.

According to the invention, the bottom wall member has a first portion connecting the first wall member to the alignment channel, and a second portion connecting the alignment channel to the second wall member. The second portion is elevated with respect to the first portion such that the first portion and the elongated flashing member are located along a predetermined plane when the first and second bar members are secured in a side-by-side abutting relation. An elongated U-shaped leveling member is located within the first and second bar members overlying the elongated alignment channels thereof for securing the first and second bar members against relative movement in level end-to-end abutting relation.

Each of the elongated horizontal bar members also preferably includes an outer wall member located in substantial parallel aligned relation to the second wall member thereof and having inner and outer peripheral surfaces. A support wall member joins the outer peripheral surface of the second wall member to the inner peripheral surface of the outer wall member to form first and second water drainage channels between the second and outer wall members of each horizontal bar member. The support wall member includes a channel therethrough connecting the first and second water drainage channels to form a concealed gutter. Moreover, the outer peripheral surfaces of the first and outer wall members of each horizontal bar member include an elongated channel formed therein for supporting a decorative light track.

Preferably, the sill structure also includes a vertical elongated bar member supported transversely to the first and second horizontal bar members and having first and second wall members located in substantially parallel aligned relation. The vertical bar member includes a third wall member interconnecting the first and second wall members, and one or more of the wall members of the vertical bar member also has an elongated channel formed therein for supporting a decorative light track.

According to yet another feature of the invention, the sill structure includes a continuous vertical closure member attached to a fourth wall of the vertical elongated bar member via one or more spaced screws. The vertical closure member has an outer peripheral surface which is flush with the outer peripheral surface of the outer wall member. Outer peripheral surface of the closure member includes a removable snap-in light track support.

BRIEF DESCRIPTION OF THE DRAWINGS

For a more complete understanding of the present invention and the advantages thereof, reference is now made to the following Description taken in conjunction with the accompanying drawings in which.

DETAILED DESCRIPTION

Figure 1:
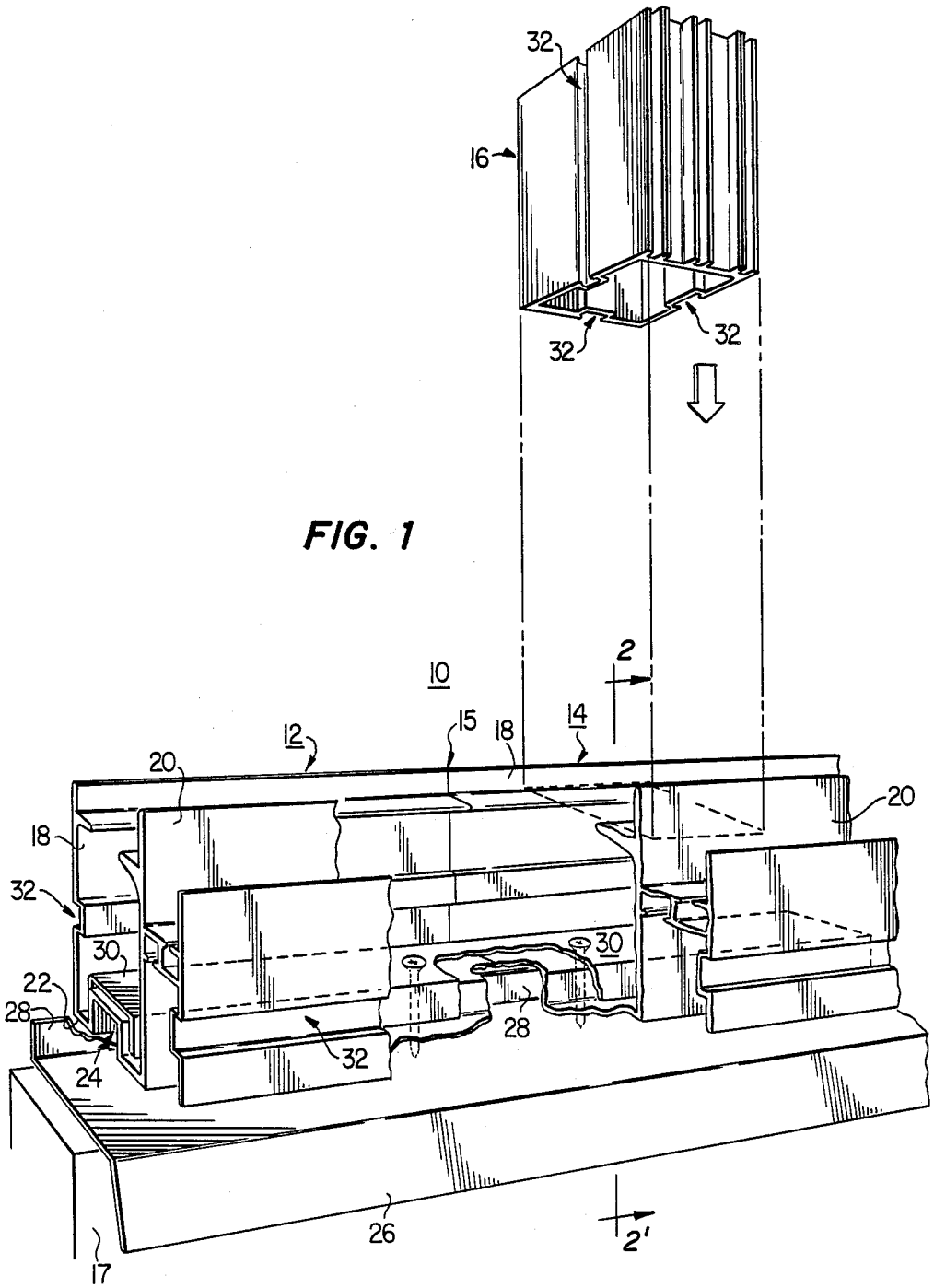
FIG. 1 is a perspective view, partially cutaway and exploded, of the preferred sill structure of the present invention.

With reference now to the FIGURES wherein like referenced characters designate like or similar parts throughout the several views, FIG. 1 shows a perspective view, partially cutaway and exploded, of the preferred sill structure 10 of the present invention. For descriptive purposes only, the following discussion describes the use of the sill structure 10 for a solarium or the like, although it should be appreciated that the sill structure of the invention is not limited for use with such building structures. Moreover, the following references to "horizontal" and "vertical" orientation is for exemplary purposes only and should not be construed to limit the scope of the present invention.

The sill structure 10 of FIG. 1 preferably comprises first and second elongated substantially horizontal bar members 12 and 14 which cooperate with a third elongated substantially vertical bar member 16 in a conventional manner to support one or more glass panes of a solarium or the like. The first and second elongated horizontal bar members 12 and 14 are normally placed in an abutting end-to-end relation at a butt joint 15 and supported on an appropriate building structure 17.

Figure 4:
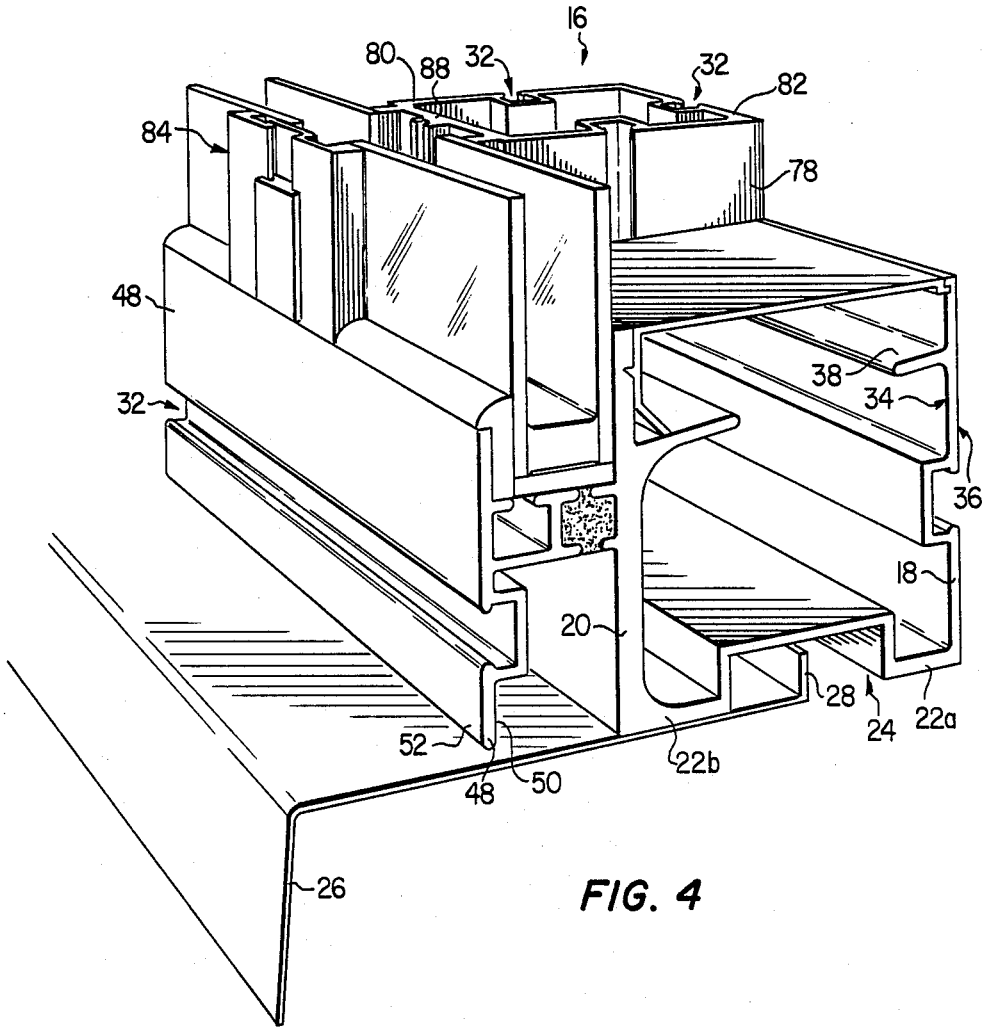
FIG. 4 is a perspective view of the complete sill structure in its assembled form.

As seen in FIGS. 1 and 4, each of the first and second elongated horizontal bar members includes first and second wall members 18 and 20 located in substantially parallel aligned relation. Each of the wall members 12 and 14 also includes a bottom wall member 22 interconnecting the first and second wall members 18 and 20. According to a feature of the invention, the bottom wall member 22 of each of the first and second elongated horizontal bar members 12 and 14 includes an elongated substantially U-shaped channel 24 formed therein and opening into the member for the purposes to be described. Although the U-shape of channel 24 is preferred, it is not meant to be limiting as other arrangements (such as a "V" or a semi-circle) are suitable. Moreover, the alignment channel 24 need not be formed along the entire length of the member as shown in FIG. 1.

The sill structure 10 also includes an elongated flashing member 26 underlying the firs and second bar members and having a raised edge portion 28 supported for transverse movement in the elongated U-shaped channels 24 of the first and second horizontal bar members 12 and 14. As will be described in more detail below, the sill structure 10 also includes a substantially U-shaped leveling member 30 located within the first and second bar members 12 and 14 overlaying the elongated U-shaped channels 24 thereof for securing the first and second bar members 12 and 14 against relative movement in a level side-by-side abutting relation in conjunction with the elongated flashing member 26. Of course, the shape of leveling member 30 is designed to cooperate with the shape of the alignment channels 24 and therefore the shape of member 30 shown in FIG. 1 is not meant to be limiting. As will be described in more detail below, the sill structure 10 also includes elongated channels 32 for supporting decorative light tracks. As used herein, a "decorative light track" is a built-in strip which encases a plurality of spaced low-voltage light bulbs.

Figure 2:
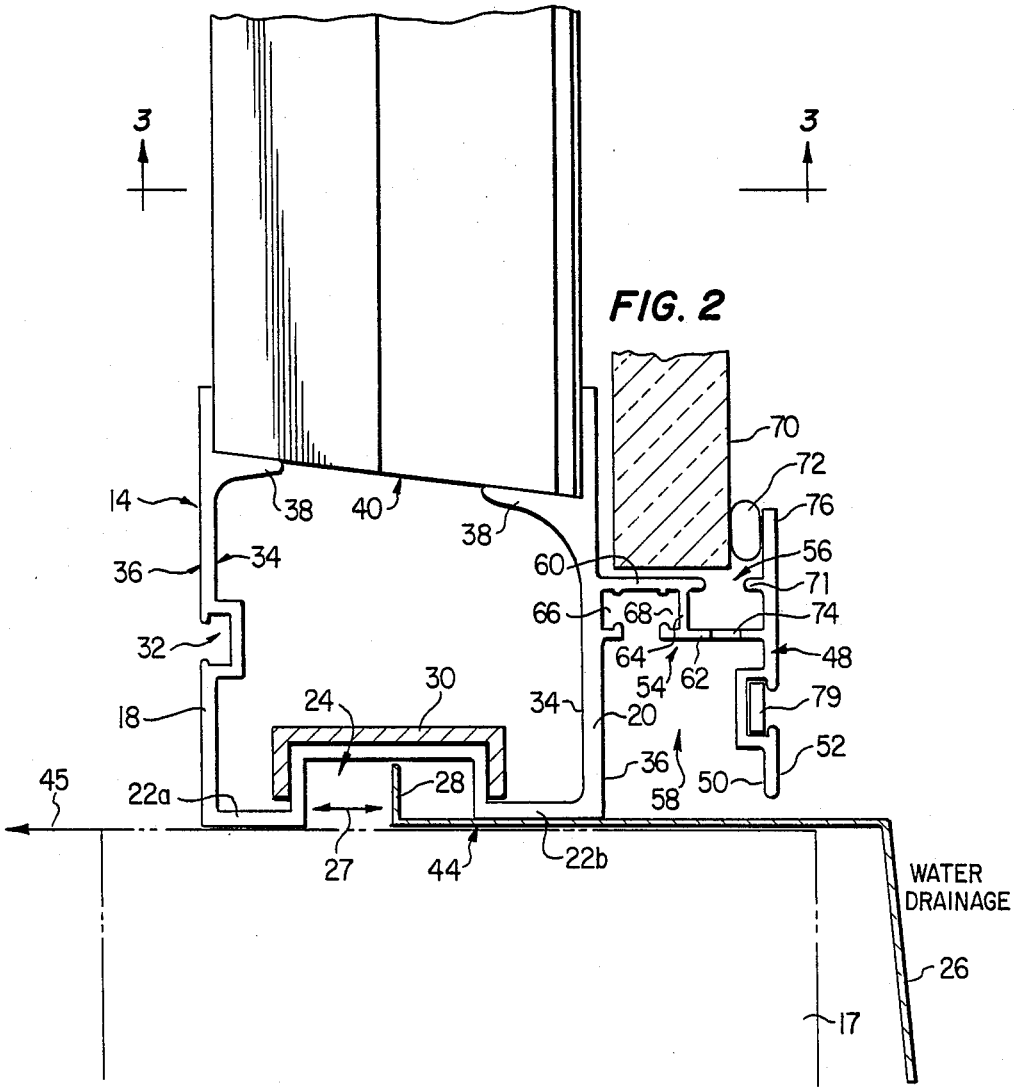
FIG. 2 is a cross-sectional view along line 2—2' of FIG. 1 showinq one of the horizontal bar members and the concealed gutter design of the present invention.

Referring now to FIG. 2, a cross-sectional view along line 2—2' of FIG. 1 is shown. As seen in FIG. 2, the first and second wall members 18 and 20 of the second horizontal bar member 14 are located in substantially parallel aligned relation and each has an inner peripheral surface 34 and an outer peripheral surface 36. The elongated substantially U-shaped channel 24 opens into the bar member 14 to enable the raised edge 28 of the flashing 26 to move transversely with respect to the elongated channel 24 as shown by arrow 27. Each of the first and second wall members 18 and 20 also include an elongated support ledge 38, as best seen in FIG. 4, for supporting a bottom edge 40 of the vertical bar member 16.

According to a feature of the invention, the bottom wall member 22 has a first portion **22*a* connecting the first wall member 12 to the alignment channel 24 and a second portion 22*b* connecting the alignment channel 24 to the second wall member 14. As seen in FIG. 2, the second portion 22*b* is elevated with respect to the first portion 22*a* such that the flashing member 26, which has a predetermined thickness, effectively raises or lowers the outward-facing portion of the sill 10 depending on the position of the sill 10 with respect to the building structure 17. Therefore, the first portion 22*a* of the bottom wall member 22 and a bottom peripheral surface 44 of the elongated flashing member 26 are located along a predetermined plane 45 when the first and second horizontal bar members 12 and 14 are secured in a level end-to-end abutting relation by the U-shaped leveling member 30. This structural relationship advantageously provides self-leveling of the sill structure when the first and second elongated horizontal bar members 12 and 14 are placed in an abutting end-to-end relation in conjunction with the leveling member 30**.

As also seen in FIGS. 2 and 4, the elongated bar member 14 includes an outer wall member 48 located in substantially parallel aligned relation to the second wall member 20 and including inner and outer peripheral surfaces 50 and 52, respectively. A support wall member 54 joins the outer peripheral surface 36 of the second wall member 20 to the inner peripheral surface 50 of the outer wall member 48 to form first and second drainage channels 56 and 58 between the second wall member 20 and the outer wall member 52. Specifically, the support wall member 54 includes a first horizontal protrusion 60, a second horizontal protrusion 62 and an interconnecting member 64. The outer peripheral surface 36 of the second wall member 20, the first horizontal protrusion 60 and the innerconnecting member 64 are provided with suitable facing grooves 66 and 68 which have reentrant angles therein so that a thermal break member (not shown) may be entrapped therein to prevent heat transfer. The first horizontal protrusion 60 supports the glazing or glass pane(s) 70, and a suitable gasket 72 supports the glass pane 70 against the inner peripheral surface 50 of the outer wall member 48. A flange 71 prevents the gasket 72 from falling into and clogging the drainage channel 56.

According to a feature of the invention, the support wall membr 54 includes one or more spaced channels 74 therethrough connecting the first and second water drainage channels 56 and 58 to form a concealed gutter for draining water away from the sill structure. In prior art structures, water is generally drained through an aperture in the upper portion 76 of the outer wall member 48. As also seen in FIG. 2, the concealed gutter allows water drainage through the channel(s) 74, through the second drainage channel 58 and away from the structure via the flashing member 26. The use of the concealed gutter enables the outer wall member 48 to include the elongated channel 32 for supporting a decorative light track 79.

Figure 3:
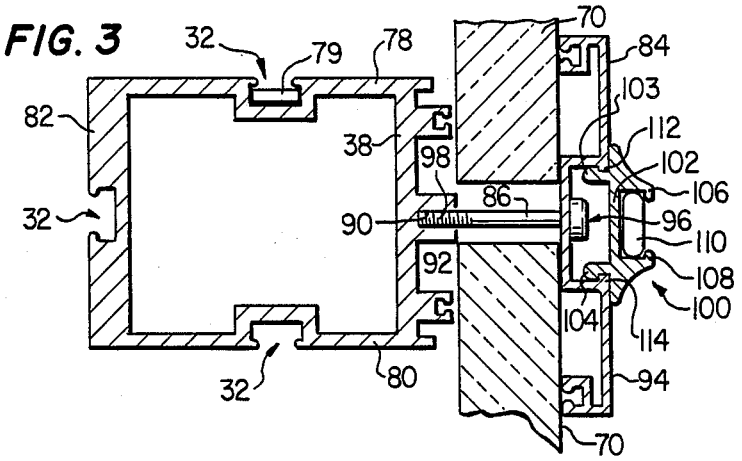
FIG. 3 is a cross-sectional view along line 3—3' of FIG. 2 showing the elongated channels formed in the vertical bar member and the continuous vertical closure member.

Referring now to FIG. 3, a cross-sectional view along line 3—3' of FIG. 2 is shown detailing the structure of the vertical bar member 16. As seen in FIG. 3, the vertical bar member 16 preferably includes first and second wall members 78 and 80 located in substantially parallel aligned relation, and a third wall member 82 interconnecting the first and second wall members. Preferably, one or more of the wall members 78, 80 or 82 of the third bar member 16 has an elongated channel 32 formed therein for supporting a decorative light track 79. As also seen in FIG. 3, the sill structure 10 of the present invention includes a continuous vertical closure member 84 which is attached to the vertical bar member 16 via one or more vertically-spaced screws 86. In particular, the vertical bar member 16 has a fourth wall member 88 with a vertically-extending threaded slot 90. The vertical closure member 84 includes a U-shaped channel 92 in its outer peripheral surface 94 for supporting the head portion 96 of the screw 86. The screw 86 includes a threaded shank portion 98 which cooperates with the threaded slot 90 to sandwich the glass panes 70 against the vertical bar member 16 as shown. The outer peripheral surface 94 of the closure member 84 is designed to be flush with the outer peripheral surface 52 of the outer wall member 48 when the sill in completely assembled as seen in FIG. 4.

As also seen in FIG. 3, according to the invention the U-shaped channel 92 of the closure member 84 is sufficiently dimensioned to receive a removable light track support 100. In particular, light track support 100 has a body portion 102, a pair of inwardly-extending flanges 103 and 104, and a pair of outwardly-extending track support members 106 and 108 for retaining a light track 110. The inwardly-extending flanges 103 and 104 cooperate with a pair of mating flanges 112 and 114 of the U-shaped channel 92 to retain the removable light track support 100 in place.

Accordingly, an improved sill structure for supporting one or more glass panes of a solarium or the like is described. This structure enables the sill to be self-leveled without the use of shims or the like through the use of a leveling member which cooperates with a plurality of elongated substantially U-shaped alignment channels in each of the horizontal bar members. Moreover, each of the horizontal bar members includes a suitable support structure for supporting the glass pane of the solarium and at the same time providing a concealed gutter to provide improved drainage. Each of these structural members also includes suitable elongated channels for supporting decorative light tracks.

Although the present invention has been described and illustrated in detail, the same is by illustration an example only and is not to be taken by way of limitation, the spirit and scope of the invention being limited only by the terms of the appended claims.

I claim:

1. A sill structure for supporting a glass pan of a solarium, comprising:

at least first and second elongated bar members, each of the bar members including:

first and second wall members located in substantially parallel aligned relation and 3 each having an outer peripheral surface, and a bottom wall member interconnecting the first and second wall members, the bottom wall member having first and second portions and an elongated alignment channel formed in the bar member, the second portion of the bottom wall member being elevated with respect to the first portion; and means for supporting the glass pane against the outer peripheral surface of the second wall member; and an elongated flashing member underlying the first and second bar members, the flashing member having a predetermined thickness and a raised edge portion supported for transverse movement in the elongated channels of the first and second bar members for adjusting the position of the elongated flashing member relative to the first and second bar members; and an alignment member located within the first and second bar members and overlaying the elongated alignment channels thereof for cooperating with the flashing member and the elevated second portion of each bottom wall member to maintain the first and second bar members in aligned end-to-end abutting relation when the alignment member is secured to the elongated bar members.

2. The sill structure as described in claim 1 wherein the means for supporting the glass pane of each of the elongated bar members comprises:

an outer wall member located in substantially parallel aligned relation to the second wall member and having inner and outer peripheral surfaces; and a support wall member joining the outer peripheral surface of the second wall member to the inner peripheral surface of the outer wall member to form first and second water drainage channels between the second and outer wall members.

3. The sill structure as described in claim 2 wherein the support wall member includes a channel therethrough connecting the first and second water drainage channels to form a concealed gutter.

4. The sill structure as described in claim 3 wherein the outer peripheral surface of the outer wall member has an elongated channel formed therein for supporting a light track.

5. The sill structure as described in claim 1 further including:

a third elongated bar member supported transversely to the first and second elongated bar members and having first and second wall members located in substantially parallel aligned relation, and a third wall member interconnecting the first and second wall members.

6. The sill structure as described in claim 5 wherein one or more of the wall members of the third elongated bar member has an elongated channel formed therein for supporting a light track.

7. The sill structure as described in claim 5 further including a vertical closure member attached to the third elongated bar member and including a removable light track support.

8. The sill structure as described in claim 1 wherein the outer peripheral surface of the first wall member has an elongated channel formed therein for supporting a light track.

9. A sill structure for supporting glazing of a solarium, comprising:

a first elongated bar including first and second wall members located in substantially parallel aligned relation, the first elongated bar also including a bottom sill member interconnecting the first and second wall members;

a second elongated bar supported transversely to the first elongated bar and having an inner wall member, an outer wall member and a pair of wide wall members between said inner and outer wall members, the outer wall member for supporting the glazing, wherin at least one of the inner and side wall members includes an elongated channel formed therein;

a closure member attached to the outer wall member of the second elongated bar member, the closure member having a substantially U-shaped channel formed therein;

removable light track support means supported in the U-shaped channel of the closure member, the removable light track support means having a body portion and a pair of opposed track support members extending outwardly from said body portion;

a first decorative light track having a plurality of spaced low voltage bulbs, the first decorative light track retained within the removable light track support means by the opposed track support members such that substantially no portion of the first decorative light track projects beyond the opposed track support members; and a second decorative light track having a plurality of spaced low voltage bulbs, the second decorative light track retained within the elongated channel of one of said inner or side wall members.

* * * * *